US010426988B1

(12) United States Patent
Davies

(10) Patent No.: US 10,426,988 B1
(45) Date of Patent: Oct. 1, 2019

(54) RESISTANCE EXERCISE DEVICE

(71) Applicant: Phillip Davies, Lafayette, PA (US)

(72) Inventor: Phillip Davies, Lafayette, PA (US)

( * ) Notice: Subject to any disclaimer, the term of this patent is extended or adjusted under 35 U.S.C. 154(b) by 0 days.

(21) Appl. No.: 16/269,043

(22) Filed: Feb. 6, 2019

Related U.S. Application Data

(60) Provisional application No. 62/755,653, filed on Nov. 5, 2018, provisional application No. 62/687,588, filed on Jun. 20, 2018.

(51) Int. Cl.

| | |
|---|---|
| ***A63B 21/008*** | (2006.01) |
| ***A63B 21/00*** | (2006.01) |
| ***A63B 23/12*** | (2006.01) |
| ***A63B 15/00*** | (2006.01) |
| ***A63B 23/035*** | (2006.01) |

(52) U.S. Cl.
CPC ..... *A63B 21/0088* (2013.01); *A63B 15/00* (2013.01); *A63B 21/0004* (2013.01); *A63B 23/03541* (2013.01); *A63B 23/12* (2013.01); *A63B 2225/01* (2013.01)

(58) Field of Classification Search
CPC ..... A63B 21/0004; A63B 21/0088; A63B 23/03541; A63B 23/12; A63B 69/36; A63B 2225/01
See application file for complete search history.

(56) References Cited

U.S. PATENT DOCUMENTS

| | | | | |
|---|---|---|---|---|
| 1,160,490 A | | 11/1915 | Bourikas | |
| 1,505,473 A | | 8/1924 | Klubnick | |
| 3,463,492 A | | 8/1969 | White | |
| 3,809,397 A | * | 5/1974 | Gruenewald | A63B 69/0002 473/228 |
| 4,086,722 A | | 5/1978 | Brown | |
| 4,878,673 A | | 11/1989 | Pollard | |
| 5,002,275 A | | 3/1991 | Beutler et al. | |
| 5,058,890 A | * | 10/1991 | Szabo | A63B 69/0002 473/457 |
| 5,087,220 A | | 2/1992 | Cotita | |

(Continued)

OTHER PUBLICATIONS

Gamboa, R. (Oct. 14, 2011, Oct. 14). The AIROPE. Retrieved from https://www.youtube.com/watch?v=14Ztv0wOCsw. (Year: 2011).*

*Primary Examiner* — Joshua Lee
(74) *Attorney, Agent, or Firm* — Caesar Rivise, PC

(57) ABSTRACT

A resistance exercise device includes: an elongated handle having first and second handle ends; an elongated element having first and second ends defining a longitudinal axis, at least part of the elongated element being flexible; a coupling connecting the elongated element near the first end to the elongated handle near the first handle end; and resistance fins attached to the elongated element, disposed around and along part of the elongated element, and oriented outwardly from the longitudinal axis, the elongated element and attached resistance fins being at least generally symmetrical along the longitudinal axis, whereby when whirled, the elongated element and the attached resistance fins prevent rotation about the longitudinal axis and produce a substantially continuous resistance exercise. A method of exercising includes: providing the resistance exercise device; holding the elongated handle by a user; and whirling the elongated element and attached fins about the elongated handle.

24 Claims, 8 Drawing Sheets

(56) References Cited

U.S. PATENT DOCUMENTS

| | | | | | |
|---|---|---|---|---|---|
| 5,100,148 | A * | 3/1992 | Smith | A63B 15/00 | 473/228 |
| 5,215,307 | A | 6/1993 | Huffman | | |
| 5,310,188 | A * | 5/1994 | Hernberg | A63B 69/3632 | 473/206 |
| 5,395,107 | A * | 3/1995 | De Pippo | A63B 21/0088 | 473/228 |
| 5,531,657 | A * | 7/1996 | Macedo | A63B 21/0084 | 482/106 |
| 5,895,341 | A | 4/1999 | Jones | | |
| 6,206,537 | B1 | 3/2001 | Hauck | | |
| 6,881,156 | B1 * | 4/2005 | Phillips | A63B 69/3632 | 473/228 |
| 6,887,188 | B1 | 5/2005 | Davies | | |
| 7,112,152 | B1 * | 9/2006 | Chen | A63B 21/0088 | 473/457 |
| 7,458,900 | B1 * | 12/2008 | Park | A63B 21/0088 | 473/226 |
| 7,621,854 | B2 | 11/2009 | Foxman | | |
| 8,998,740 | B2 | 4/2015 | Corcoran et al. | | |
| 9,387,356 | B2 | 7/2016 | Jaidar | | |
| 2004/0002408 | A1 | 1/2004 | Rigas | | |
| 2005/0215339 | A1 * | 9/2005 | Namba | A63B 21/0088 | 473/228 |
| 2005/0266965 | A1 | 12/2005 | Foxman | | |
| 2005/0288158 | A1 | 12/2005 | LaTour | | |
| 2006/0128534 | A1 | 6/2006 | Roque | | |
| 2010/0093502 | A1 | 4/2010 | Marji | | |
| 2011/0160004 | A1 * | 6/2011 | Imatoh | A63B 21/0088 | 473/422 |
| 2011/0306474 | A1 | 12/2011 | Gamboa et al. | | |
| 2017/0249446 | A1 | 8/2017 | Wright | | |

* cited by examiner

RESISTANCE EXERCISE DEVICE

CROSS-REFERENCE TO RELATED APPLICATIONS

This non-provisional application claims the priority benefits of U.S. Provisional Patent Application Ser. No. 62/755,653 filed Nov. 5, 2018 by the present inventor, and also claims the priority benefits of U.S. Provisional Patent Application Ser. No. 62/687,588 filed Jun. 20, 2018 by the present inventor. The entire disclosures of both said provisional patent applications titled Resistance Exercise Device are hereby expressly incorporated by reference herein.

STATEMENT REGARDING FEDERALLY SPONSORED RESEARCH OR DEVELOPMENT

None.

REFERENCE TO A SEQUENCE LISTING, A TABLE, OR A COMPUTER PROGRAM, LISTING COMPACT DISC APPENDIX

None.

BACKGROUND

Field of the Invention

The present invention relates generally to exercise equipment, and more particularly to rotary resistance exercise devices.

Background Information

Aerobic conditioning and strength building exercise are very important for maintaining good health. Jumping rope provides excellent aerobic exercise and very good strength building. Rotary resistance exercise from jump ropes can provide high intensity upper-body training. However, a jump rope allows only a few, restricted arm movements, which limits the number of muscles and joints that can engage in and benefit from rotary resistance exercise. Also, jumping rope allows only limited lower body movements, and learning to jump rope is quite difficult. This has led to the development of jump rope simulators that replace a single rope with two separate hand held twirling members and other rotary resistance devices which can be used in pairs. These devices fall into several categories. There are jump rope simulators that are flexible, where each hand held unit is typically comprised of a handle that is connected to one end of a piece of rope or an elongated member and an optional object fastened to the other end, such as a tassel, shuttle cock or a ball. Other flexible jump rope simulators include a cord loop. However, these flexible devices provide limited rotary resistance exercise. Another category of rope simulators include rotating weighted elements, but which when twirled, can hit and injure people. Another category is semi-rigid rotary resistance exercisers, which require a rigid mechanism to maintain an angle between the handle and the rotating portion so that the latter does not hit the user, but which are cumbersome and limited in their use. None of these devices realistically emulates jump rope rotary resistance exercise, especially a jump rope's balance of air and weight resistance.

Another type of rotary resistance device is designed for improving a user's swing for specific sports, such as golf, baseball or tennis. These devices include a shaft and provide the resistance using weight and/or relatively large air resistance fins or vanes proximate the distal end. By definition, a shaft maintains its typically straight shape and is rigid, or it is at least substantially rigid with some flexing during a user's swing. These devices have their own shaft or attach to a piece of sports equipment, such as a baseball bat or a golf club. Rigid shaft based rotary resistance devices are potentially useful for building strength and improving a specific swinging motion. The rigid shaft, as well as the large air resistance fins, while effective for executing individual swings, are unsuitable for continuous twirling exercise and the aerobic, strengthening, high-intensity training and endurance benefits thereof.

So there is a need for an improved rotary resistance exercise device that can be used as a single unit or in pairs for aerobic, strength, high intensity and endurance training or used in pairs to provide realistic jump rope exercise including the proper balance of weight and air resistance. Also, there is a need for an improved rotary resistance device that provides flexibility and freedom of movement, such that it can be whirled easily and continuously, and so it can provide a variety of upper body rotary resistance exercises and can be combined with many lower body exercises. Also, there is a need for a rotary resistance exercise device that is easy to use and allows different intensity levels.

BRIEF SUMMARY

There are various aspects of Applicant's resistance exercise device and methods, and there are many variations of each aspect. As used in this patent application, whirling means "moving or causing to move rapidly around and around" or "a rapid movement around and around" and includes whirling, twirling, or spinning the rotatable portion of Applicant's resistance exercise device about the handle.

One aspect is a resistance exercise device held in a hand or hands of a user and whirled in use. The exercise device includes an elongated handle, an elongated element with a defined longitudinal axis which is coupled to the elongated handle, and a plurality of resistance fins at least generally symmetrically attached to the elongated element.

There are many variations of the resistance exercise device, as discussed below. The elongated handle and the elongated element are coupled, typically rotatably coupled. The elongated element is flexible or at least has a portion that is flexible proximate the handle coupling location. The resistance fins are disposed around and along a portion of the elongated element and are oriented outwardly from the longitudinal axis. The elongated element and attached resistance fins are at least generally symmetrical along the longitudinal axis.

When the resistance exercise device is whirled in use, the elongated element and attached resistance fins provide substantially balanced air resistance, prevent rotation about the longitudinal axis and produce substantially continuous rotary resistance exercise. The rotary resistance includes both weight resistance and air resistance, with an emphasis on air resistance.

The resistance exercise device can be made in a variety of sizes. In one embodiment, the resistance exercise device has a shorter elongated element, typically shorter than a user's arm. Two of the resistance exercise devices can be used together, one in each hand, to simulate jumping rope and to perform other exercises. Another embodiment of the resistance exercise device is longer, typically longer than a user's arm, and it typically has a longer elongated handle, a longer elongated element and more resistance fins. This longer exercise device provides more resistance exercise, such that typically only a single device is used for exercising, which is usually held with two hands.

The elongated handle of the resistance exercise device has two ends, a first handle end and a second handle end. The elongated element has a first end, a second end, and a defined longitudinal axis going through the first end and the second end. At least a portion of the elongated element proximate the first end is flexible. The elongated element is coupled, typically rotatably coupled, proximate the first end to the elongated handle proximate a handle end. The resistance fins, being at least generally symmetrically disposed around and along a portion of the elongated element, are typically attached proximate a fin edge to the elongated element and oriented in an outwardly direction from the longitudinal axis.

In one exemplary embodiment, the elongated element is flexible and cord shaped and is rotatably coupled at or near the first end to the elongated handle at or near the first handle end by a coupling. The resistance fins are typically flat and approximately two inches long and two inches wide in this embodiment. The resistance fins are arranged in groups along a portion of the elongated element, and each group typically includes three or four resistance fins that are generally symmetrically positioned around the elongated element.

In another exemplary embodiment, the resistance fins are not directly attached to the elongated element. Instead, small numbers of resistance fins are attached together to create separate fin modules that are rotatably attached to the elongated element. A fin module has two ends and defines a central axis extending through the two ends. Typically, three or four resistance fins are attached together, typically proximate a fin edge, and are disposed around the central axis and oriented in an outwardly direction. The fin module is at least generally symmetrical along the central axis. At least one and typically four to six fin modules are rotatably attached to an elongated element in a shorter embodiment. In a longer embodiment, there are typically nine or more fin modules attached to the elongated element. The elongated element and rotatably attached fin modules are at least generally symmetrical along the longitudinal axis when the exercise device is whirled in use. This occurs due to the air resistance rotating the generally symmetrical fin modules around the elongated element until they achieve a position of substantially balanced air resistance.

In still another embodiment, the fin modules each include an axial through hole along the central axis that receives the elongated element. A fastening means is fastened to the elongated element proximate the second end to hold the fin modules on the elongated element. The fastening means can be releasably fastened to allow changes to the configuration of the resistance exercise device, such as adding or changing fin modules, weights, lights and other components.

In other embodiments of Applicant's resistance exercise device, elongated handles, elongated elements, resistance fins and fin modules can be different sizes and different configurations.

During use of Applicant's resistance exercise device, the resistance on an individual fin is relatively low. As such, the fins can be comprised of soft materials, including flexible plastic, rubber, foam rubber or other materials, and still provide effective resistance. The elongated element is typically made of a flexible material.

Applicant's resistance exercise device is easy to learn and easy to use. The device provides different resistance levels, which combined with the ease of use, makes it suitable for users of all ages and skill levels. The flexibility of the elongated element and it's relatively short length provides freedom of movement and allows a wide variety of arm and upper body exercises, and this design allows the device to be combined with almost any kind of lower body exercise. A shorter embodiment of the device provides resistance and aerobic exercise for a full body workout. A longer embodiment typically provides more emphasis on resistance exercise and less emphasis on aerobic exercise, but the legs and core can still be engaged and exercised vigorously to provide a full body workout including aerobic conditioning. Both embodiments provide high intensity, explosive training for the upper body. This dynamic exercise develops more power, more strength and more endurance, and improves athletic performance by strengthening the joints and muscles in ways that that go largely untested in daily life and most workouts.

Another aspect is a method of exercising. There are many variations of the method.

For example, one embodiment of the method of exercising includes three steps. The first step is to provide a resistance exercise device like that described herein and illustrated in the drawings. As discussed above, there are many variations of the resistance exercise device, which means there also are many variations of Applicant's method of exercising. The second step in the method of exercising is holding in at least one hand of a user the elongated handle of the resistance exercise device. The third step is whirling the elongated element and attached fins of the resistance exercise device about the elongated handle of the resistance exercise device.

In a variation of the method of exercising, at least three resistance fins are attached proximate a fin edge to the elongated element, and further including a rotatable coupling that rotatably couples the elongated element to the elongated handle.

In another variation of the method of exercising, a fin module is comprised of at least three resistance fins attached together. The fin module has two ends defining a central axis extending through the two ends. The resistance fins are disposed about the central axis and oriented in an outwardly direction from the central axis. The fin module is at least generally symmetrical along the central axis and at least one fin module is rotatably attached to the elongated element. When the resistance exercise device is whirled in use, the elongated element and attached resistance fins are at least generally symmetrical about the longitudinal axis.

In a variant of that variation of the method of exercising, the elongated element and attached fins of the resistance exercise device are whirled about the elongated handle overhead. In another variant, the elongated element and attached fins of the resistance exercise device are whirled about the elongated handle near a side of the user. In yet another variant, the elongated element and attached fins of the resistance exercise device are whirled about the elongated handle in front of the user. In still other variants, the elongated element and attached fins of the resistance exercise device are whirled about the elongated handle at positions between the locations overhead, at the side of and in front of the user.

BRIEF DESCRIPTION OF THE DRAWINGS

Applicant's resistance exercise device and methods of exercising are best understood by reference to the following detailed description taken in conjunction with the accompanying drawings in which like reference numerals designate similar or corresponding elements and portions. The features and advantages of Applicant's resistance exercise device and methods of exercising will be more clearly understood upon reference to the drawings in which.

DETAILED DESCRIPTION

The following detailed description is of exemplary embodiments of the invention. The description is not intended to represent the only forms in which the Applicant's resistance exercise device can be constructed or utilized, but is for the purpose of illustrating the general principles of the Applicant's device and methods, because the scope of the Applicant's inventions is defined by the claims. The detailed description sets forth various inventive features that can be used independently of one another or can be used in combination with other features.

Figure 1:
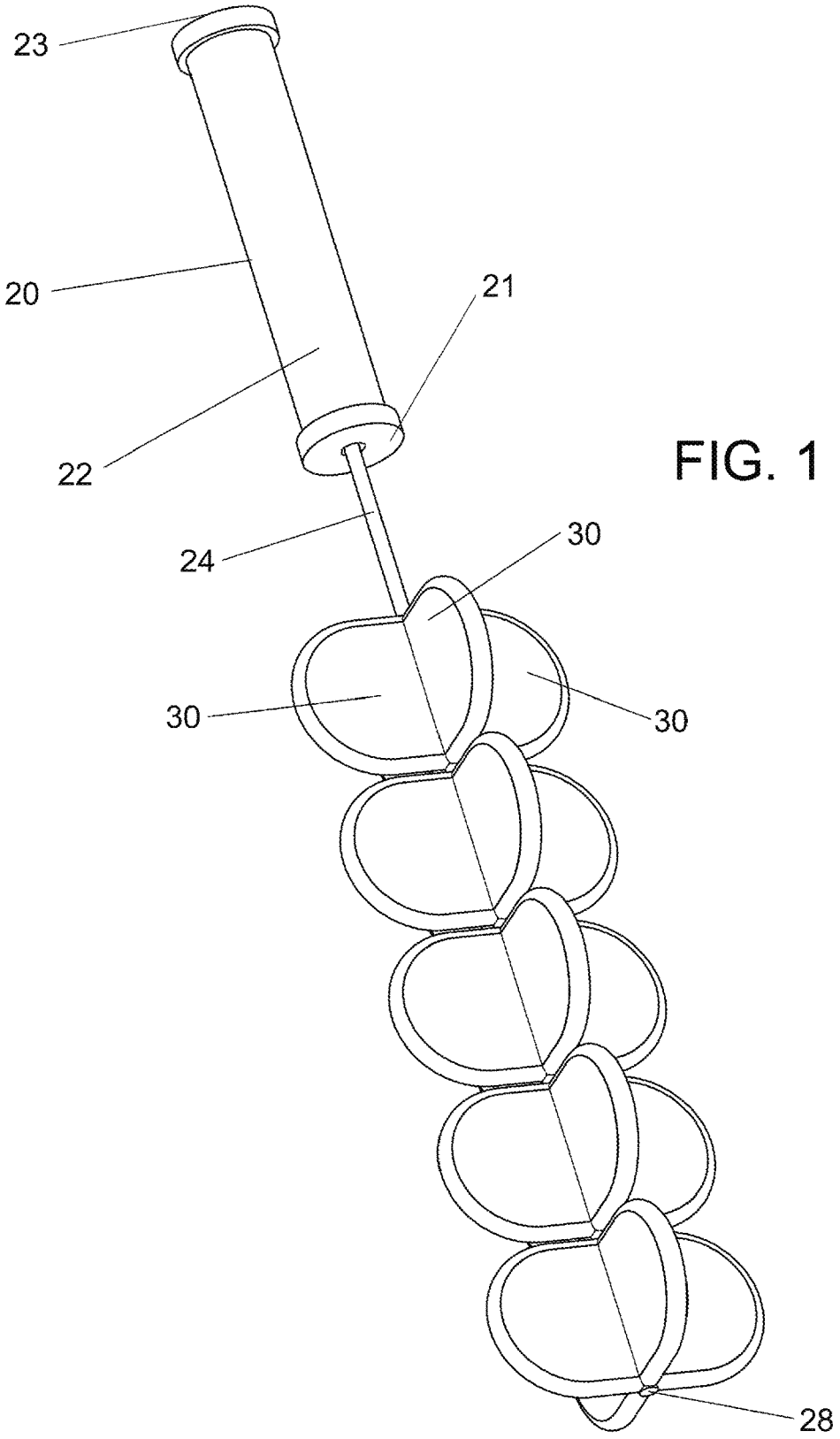
FIG. 1 is a perspective view of an exemplary embodiment of Applicant's resistance exercise device with a plurality of resistance fins attached to an elongated element.
Figure 4:
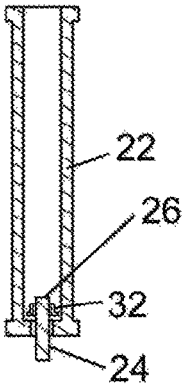
FIG. 4 is a sectional view of the elongated element rotatably coupled to the elongated handle shown in FIG. 2, taken at the sectioning plane and in the direction indicated by section lines 4-4.

FIG. 1 illustrates one embodiment of Applicant's rotary resistance exercise device 20 for holding in the hand or hands of a user and whirling in use. The resistance exercise device 20 provides both weight resistance and air resistance, with an emphasis on air resistance. The resistance exercise device 20 includes an elongated element 24 coupled to an elongated handle 22 and a plurality of resistance fins 30 attached around and along a portion of the elongated element 24. The elongated handle 22 has a first handle end 21 and a second handle end 23. The elongated element 24 has a first end 26 (shown in FIG. 4), a second end 28 and a longitudinal axis extending through the first end 26 and the second end 28. At least a portion of the elongated element 24 proximate the first end 26 is flexible, and preferably much if not all of the elongated element 24 is flexible. As shown in FIG. 4, the elongated element 24 is coupled at or near the first end 26 with a coupling 32 to the elongated handle 22 at or near a first handle end 21, and typically the elongated element 24 is rotatably coupled to the elongated handle 22. The resistance fins 30 that are attached to the elongated element 24 extend in an outwardly direction from the longitudinal axis of the elongated element 24. The resistance fins 30 are typically arranged in groups along the elongated element 24. The elongated element 24 and attached resistance fins 30 are at least generally symmetrical along the longitudinal axis of the elongated element 24. When the exercise device 20 is whirled in use, the elongated element 24 and the attached resistance fins 30 encounter air resistance that is generally balanced on either side of the longitudinal axis. This balanced air resistance prevents rotation about the longitudinal axis and produces a substantially continuous level of resistance exercise. The elongated element 24 and attached resistance fins 30 need only be generally symmetrical to provide the generally balanced resistance or lateral stability about the longitudinal axis.

In one embodiment of Applicant's resistance exercise device, the elongated handle 22 has a first handle end 21, a second handle end 23 and is cylindrical. The elongated element 24 is coupled at or near the first end 26 of the elongated element to the elongated handle 22 at a first handle end 21 of the elongated handle. As shown in FIG. 4, the elongated handle 22 includes a hollow portion, one open end, one closed end and has an opening in the closed end for receiving the elongated element 24. In another embodiment, the receiving location can be proximate the first handle end 21, such as on the side of the elongated handle 22, proximate the first handle end 21. In other embodiments, the elongated handle 22 can have two closed ends, can be substantially solid with a cavity that holds a coupling 32 and/or can include a ball bearing assembly. The elongated handle 22 can have different shapes. In one embodiment, the elongated handle 22 is made of plastic. In other embodiments, the elongated handle 22 can be made of different materials, such as wood, rubber, flexible plastic or other materials or combinations of materials. The elongated handle 22 can be manufactured using plastic injection molding or other manufacturing techniques.

Figure 3:
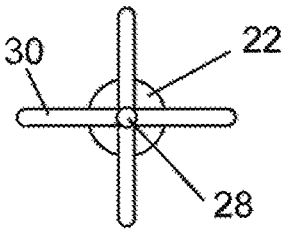
FIG. 3 is a bottom view of the embodiment of Applicant's resistance exercise device shown in FIG. 1.

Referring to FIGS. 1 and 3, in one embodiment of Applicant's resistance exercise device, the elongated element 24 is cord shaped, has a circular cross section and is made of flexible plastic. The elongated element 24 can have an oval, square, rectangular or another cross section shape. In a shorter embodiment, the length of the elongated element 24 is configured to be shorter than a user's arm. For example, the length of the elongated element 24 can be approximately 18 inches and the width or diameter of the elongated element 24 can be approximately ¼ inch. In other embodiments, the elongated element 24 can have different lengths and/or widths and can be comprised of rubber, plastic, leather, rope, steel cable or other materials or combinations of materials. The elongated element 24 can be made using injection molding or using other manufacturing techniques.

In one embodiment of Applicant's resistance exercise device, the entire elongated element 24 is flexible. In other embodiments, at least a portion of the elongated element 24 is flexible, including a portion proximate the first end 26 of the elongated element. This flexibility of at least a portion allows the elongated element 24 to be whirled at an angle, such as perpendicular to the hand held elongated handle 22, and the overall flexibility provides more safety in terms of the exercise device being softer if it hits the user. In the embodiment shown in FIG. 4, the first end 26 of the elongated element 24 is received through an opening in the first handle end 21 of the elongated handle 22 and into a hollow core. The elongated element 24 rotatably couples to the elongated handle 22 with a coupling 32, which in this embodiment is a collared crimp fastener with a diameter wider than the width of the handle opening. In other embodiments, the coupling 32 can include a ball bearing assembly and/or other couplings 32. In still other embodiments, the elongated element 24 can be coupled to the elongated handle 22 with a knot tied in the elongated element 24 at the first end 26 or a knot tied to the elongated handle 22.

Figure 5:
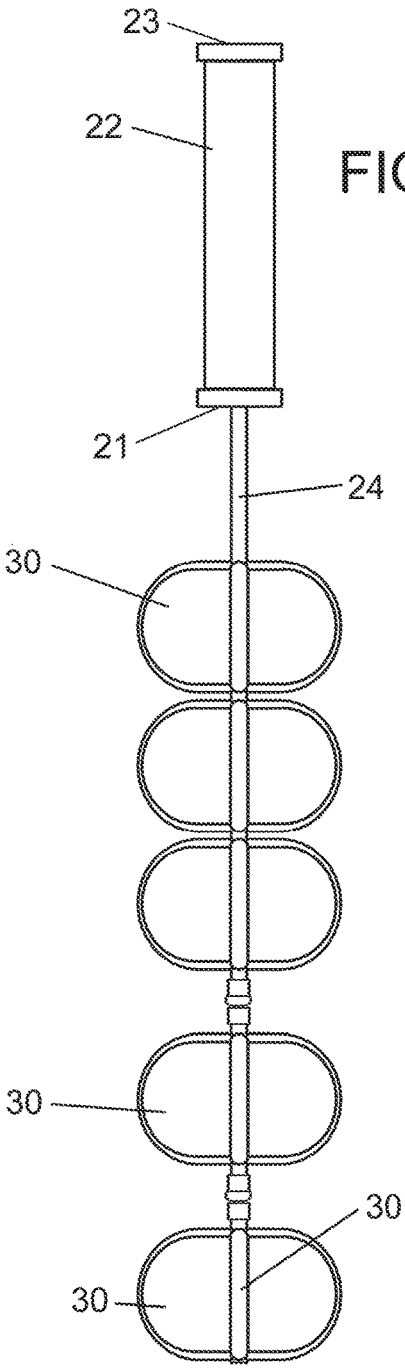
FIG. 5 is a side view of an exemplary embodiment of Applicant's resistance exercise device in which the elongated element is comprised of elongated segments.

In yet another embodiment of Applicant's resistance exercise device, the elongated element 24 is comprised of a plurality of elongated segments connected together, typically end to end, such as with snap connectors as shown in FIG. 5. Elongated segments can comprise the portion of the elongated element 24 containing the attached resistance fins 30 along with releasable connectors at both segment ends. Such an embodiment allows an elongated is segment with the resistance fins to be disconnected from one exercise device 20 and connected to the second end 28 of the elongated element 24 of another exercise device 20, and in effect creating a longer embodiment of the exercise device 20 from a pair of the shorter embodiment. In another embodiment, the elongated element 24 can be comprised in part as an elongated framework with resistance fins 30 attached to and/or built into the framework.

Referring to FIG. 1, in one embodiment of Applicant's resistance exercise device, twenty resistance fins 30 are attached to the elongated element 24. The resistance fins 30 are attached proximate an edge of the resistance fins 30, and the resistance fins 30 are disposed around and along a portion of the elongated element 24. Each attached resistance fin 30 extends or is oriented in an outwardly direction from the longitudinal axis of the elongated element 24, as shown in FIGS. 1 and 3; and each resistance fin 30 is at least generally parallel to the elongated element 24. In other embodiments, the resistance fins 30 might not be parallel to the elongated element 24.

In the first embodiment discussed in the paragraph above, the twenty resistance fins 30 are arranged in groups disposed along the elongated element 24. There are five groups, with four resistance fins 30 in each group. The resistance fins 30 of a group are positioned together around the same portion of the elongated element 24. The configuration of the elongated element 24 and attached resistance fins 30 is symmetrical or at least generally symmetrical along the longitudinal axis of the elongated element 24. As a result, when the exercise device 20 is whirled in use, the elongated element 24 and attached resistance fins 30 rotate versus the elongated handle 22 until reaching generally balanced air resistance on either side of the horizontal axis, and then provide substantially continuous resistance exercise while preventing rotation about the longitudinal axis of the elongated element.

Figure 2:
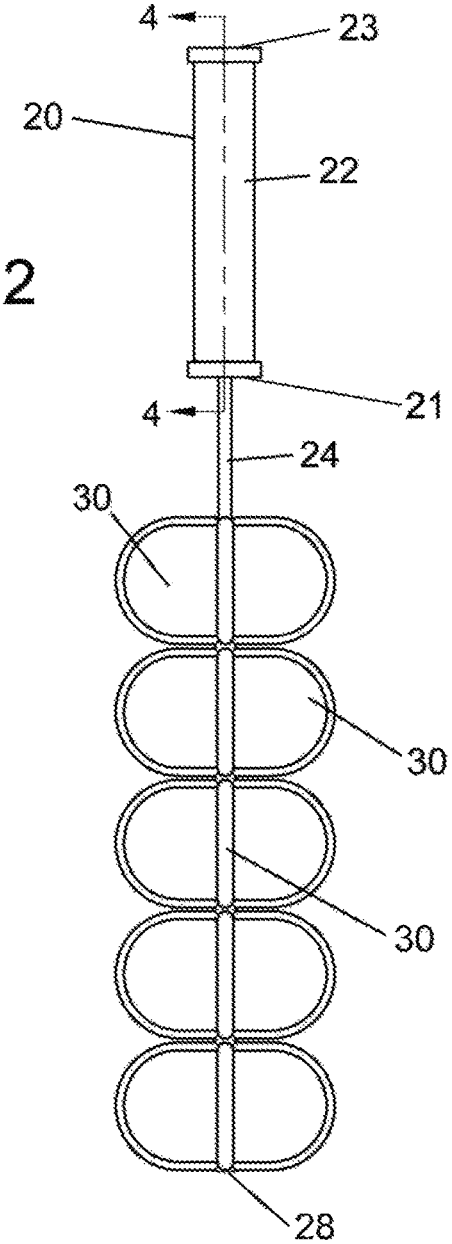
FIG. 2 is a side view of the embodiment of Applicant's resistance exercise device shown in FIG. 1.

In the above described embodiment, the four resistance fins 30 of each group are attached in the same compass directions, as shown in FIGS. 2 and 3. In another embodiment, the resistance fins 30 can be positioned in different compass directions in different groups. In other embodiments, the exercise device 20 can include different numbers of groups and/or different numbers of resistance fins 30 per group. In still another embodiment, the resistance fins 30 of a group might not be positioned together along the same portion of the elongated element 24.

In one embodiment of Applicant's resistance exercise device, each resistance fin 30 is relatively small, for example approximately 2 inches by 2 inches; and in other embodiments the resistance fins 30 can be larger or smaller than that. In another embodiment, the resistance fins 30 have a radial length of no greater than 7 inches. In most embodiments, the resistance fins 30 are lightweight, have rounded edges and corners, and are comprised of soft or semisoft materials. Resistance fins 30 can be made of materials such as rubber, foam rubber, plastic, flexible plastic, leather, other materials or combinations of different materials. The resistance fins 30 can be manufactured by injection molding or other techniques.

Figure 6:
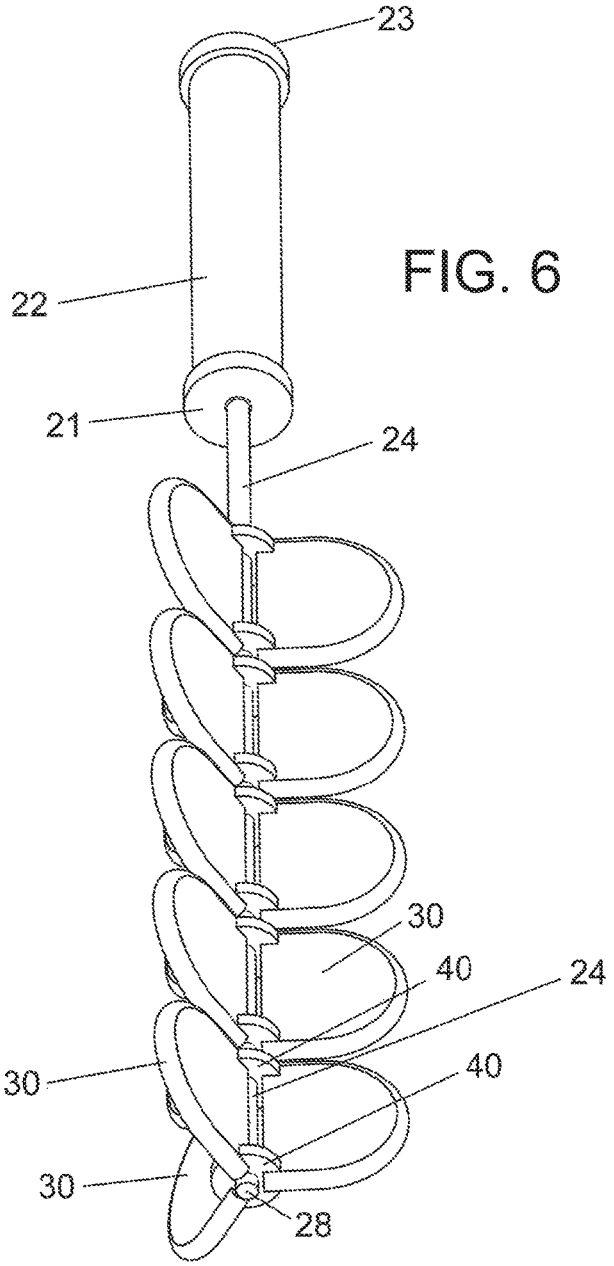
FIG. 6 is a perspective view of another exemplary embodiment of Applicant's resistance exercise device in which a plurality of resistance fins are attached to an elongated element with attachment means.
Figure 7:
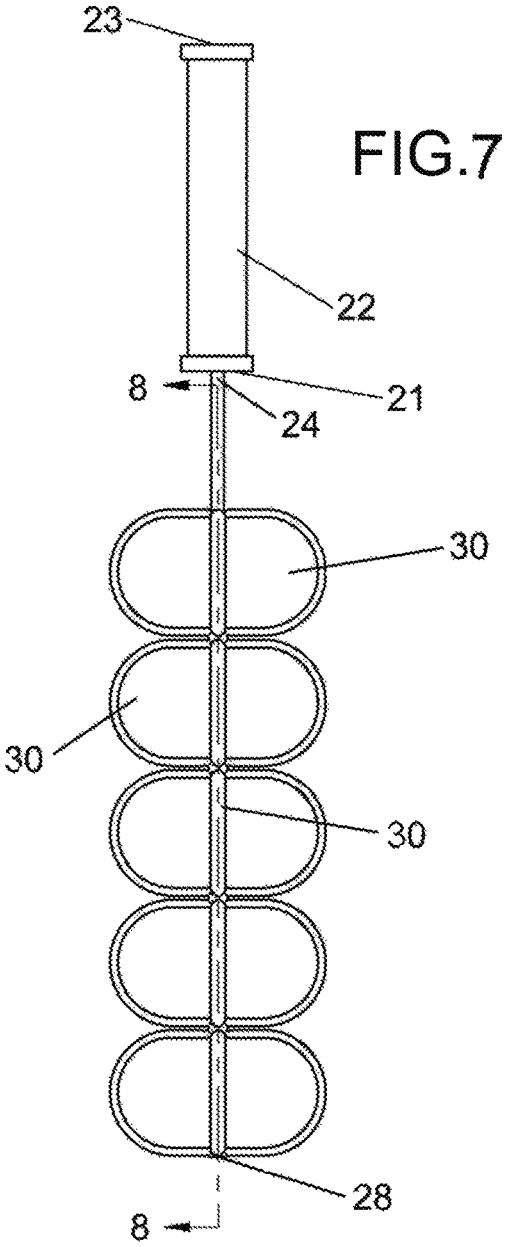
FIG. 7 is a side perspective view of an embodiment of Applicant's resistance exercise device with an elongated element and attached resistance fins made as one piece.
Figure 8:
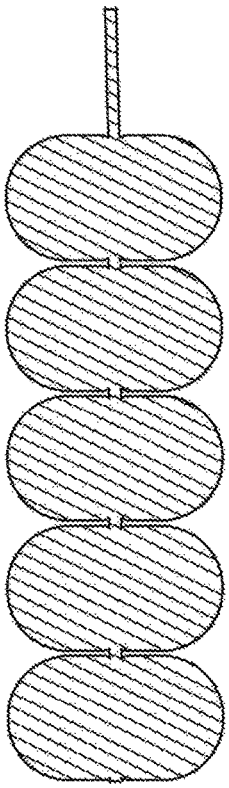
FIG. 8 is a sectional view of the elongated element and attached resistance fins shown in FIG. 7, taken at the sectioning plane and in the direction indicated by section lines 8-8.

In one embodiment of Applicant's resistance exercise device, attachment of the resistance fins 30 to the elongated element 24 includes an adhesive. In still other embodiments, resistance fins 30 can be attached to the elongated element 24 using snaps, fasteners, hook & loop fasteners and other means. In yet another embodiment, the resistance fins 30 and the elongated element 24 can be made as one piece, as shown in FIGS. 7 and 8. In yet another embodiment, the entire exercise device 20, including the elongated handle 22, elongated element 24 and attached resistance fins 30 can be made as one piece. In still another embodiment, the resistance fins 30 are attached to the elongated element 24 with attachment means 40 as shown on FIG. 6. In other embodiments, the attachment means 40 can have other shapes and other attachment configurations, including having a separate attachment means 40 for individual resistance fins 30.

In one embodiment of Applicant's resistance exercise device, the resistance fins 30 are straight with flat sides. In another embodiment, the resistance fins 30 have curved sides or have different shapes. In some embodiments, resistance fins 30 are attached with an attaching edge proximate the elongated element 24. In another embodiment, the resistance fins 30 are attached with an attaching edge not proximate the elongated element 24, such as when the resistance fins 30 are attached to the elongated element 24 with attachment means 40. In yet another embodiment, a resistance fin 30 can be configured as an adjustable size fin, such as with a top fin section that slides up and down over a bottom fin section to provide changes in size and resistance.

Figure 9:
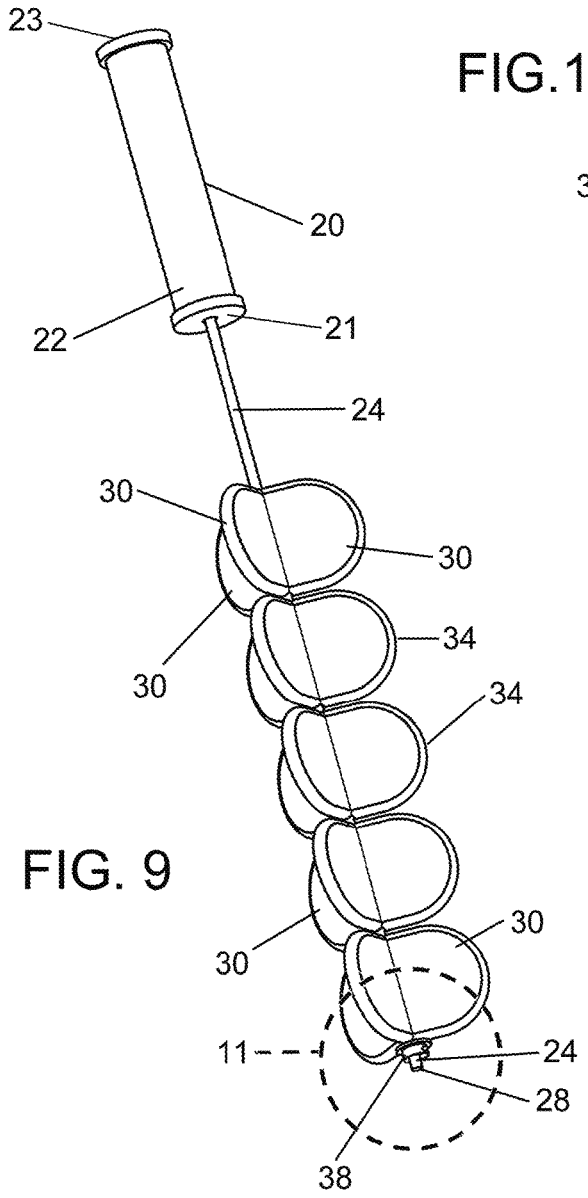
FIG. 9 is a perspective view of another exemplary embodiment of Applicant's resistance exercise device with a plurality of resistance fins configured in fin modules.

Referring to FIG. 9, in another embodiment of Applicant's resistance exercise device, a plurality of resistance fins 30 are attached together, comprising a fin module 34, which is rotatably attached to the elongated element 24. The fin module 34 has two ends and defines a central axis extending through the two ends. Each of the resistance fins 30 is oriented in an outwardly direction from the central axis. In one embodiment of Applicant's resistance exercise device, each resistance fin 30 is approximately 2 inches by 2 inches; and in other embodiments the resistance fins 30 can be larger or smaller than that. In another embodiment, the resistance fins 30 have a radial length of no greater than 7 inches. The fin module 34 is at least generally symmetrical along the central axis. At least one fin module 34 is rotatably attached to the elongated element 24. The number of fin modules 34 attached to the elongated element 24 is generally four to seven in one shorter embodiment of the invention, and the number of resistance fins 30 per fin module 34 is generally three to six. In other embodiments, the number of attached fin modules 34 and/or the number of resistance fins 30 per fin module 34 can be different. The elongated element 24 and attached resistance fins 30 are at least generally symmetrical along the longitudinal axis of the elongated element when whirled in use. This occurs due to the air resistance rotating each of the freely rotating fin modules 34 until achieving a position of generally balanced air resistance about the longitudinal axis of the elongated element.

One embodiment of Applicant's resistance exercise device includes an elongated element 24 with resistance fins 30 directly attached plus at least one fin module 34 rotatably attached. In this embodiment, one or more fin modules 34 can be rotatably attached to the elongated element 24, typically proximate the second end 28 and including a fastening means 38. In another embodiment, resistance fins 30 are attached with an attaching edge proximate the central axis of a fin module 34. In some other embodiments, attaching edges are not proximate the central axis of a fin module or a mix of both types of attaching resistance fins 30 are included. In yet another embodiment, the elongated handle 22 and elongated element 24 are made as one piece, typically made from flexible plastic.

Figure 16:
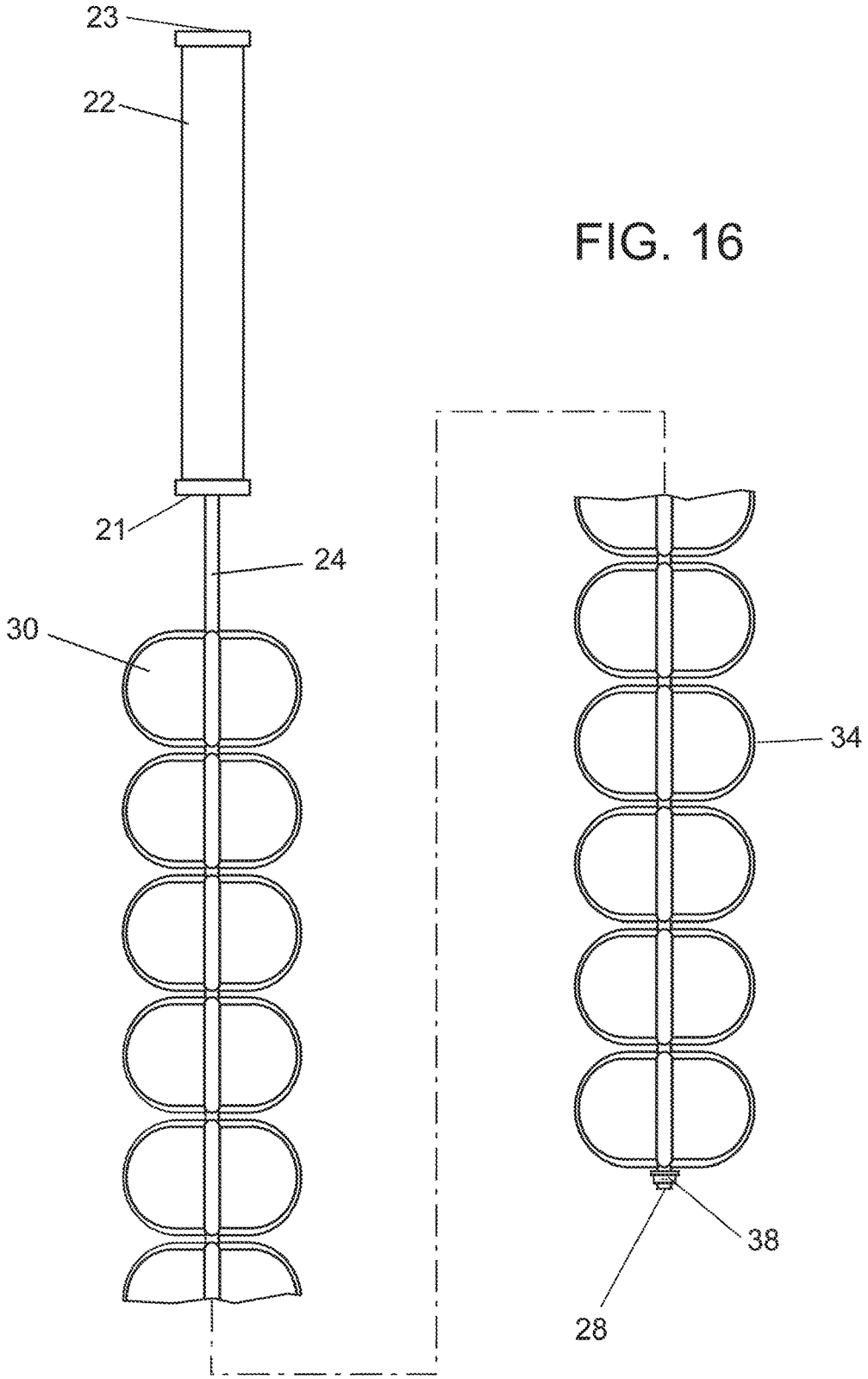
FIG. 16 is a perspective view of another exemplary embodiment of Applicant's resistance exercise device shown in FIG. 9 with a longer elongated handle and a longer elongated element, as well as more fin modules.

One longer embodiment of Applicant's resistance exercise device typically has 10 to 14 fin modules 34 attached to the elongated element 24, as shown in FIG. 16. However, the number of fin modules 34 attached to the elongated element 24 can be less or more than 10 to 14 fin modules 34. Here, the elongated element 24 is typically longer than a user's arm and is long enough to attach the larger number of fin modules 34. The elongated handle 22 is typically longer also, so that it can be held with one or two hands. This longer embodiment is more often held and whirled with two hands, such as whirling horizontally overhead, whirling vertically at the side or in front, and whirling overhead at a 45 degree angle (or other angles), as well as whirling criss cross and other exercise movements. These same exercises can be done with one arm, especially by stronger users. The exercise here provides more strength building than a shorter embodiment of the resistance exercise device and provides lower body/core exercise. And while not as many lower body exercises can be done versus using the shorter embodiment, the lower body can be engaged to provide a full body workout with the longer embodiment. Also, the longer embodiment compliments the shorter embodiment. The two embodiments can be used for different workouts or used in the same workout where the user switches between the longer embodiment with its emphasis on strength building and the shorter embodiment which provides balanced strength building and aerobic conditioning. Also, the two different embodiments exercise and strengthen muscle groups in slightly different ways.

Figure 10:
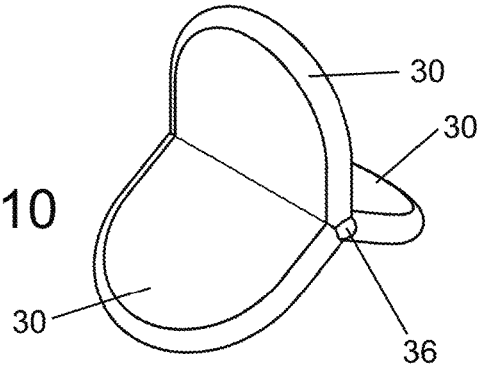
FIG. 10 is a perspective view of a fin module comprised of three resistance fins and including an axial through hole.
Figure 11:
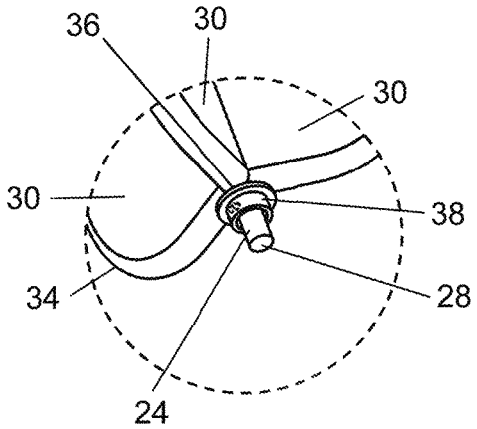
FIG. 11 is an enlarged view of a fastening means attached to a distal end of the elongated element shown in FIG. 9.

In one embodiment of Applicant's resistance exercise device, the fin module 34 includes an axial through hole 36 along the central axis, as shown in FIG. 10. The elongated element 24 is positioned through the axial through hole 36 in order to rotatably fasten the fin module 34 to the elongated element 24. Referring to FIG. 11, a fastening means 38 is fastened proximate the second end 28 of the elongated element 24. The fastening means 38 here is a collared crimp fastener and could be a different type of fastening means 38 in other embodiments of the invention. The fastening means 38 keeps the fin modules 34 with axial through holes 36 fastened to the elongated element 24. In another embodiment, a safety covering that is hollow shaped, such as a hollow sphere or other shape, and comprised of soft plastic, rubber or another soft material, fits over the fastening means 38. This safety covering protects users or others from being hit by the fastening means 38, which typically is made from metal, hard plastic or other materials.

Figure 12:
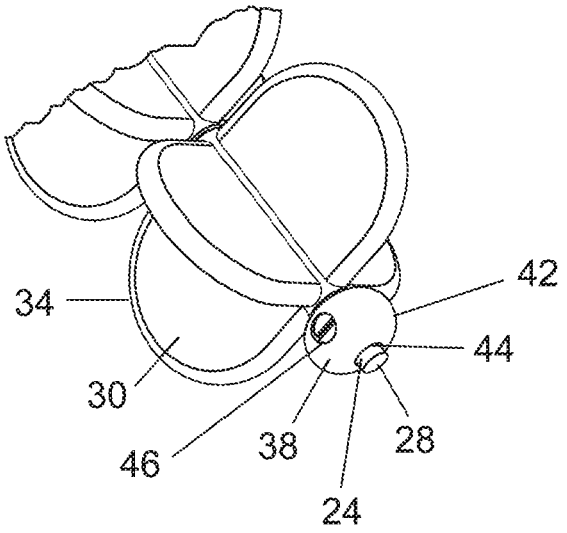
FIG. 12 is a partial perspective view of another exemplary embodiment of Applicant's resistance exercise device with a releasable fastening means that includes a fastening body with a receiving hole and a fastening screw.
Figure 13:
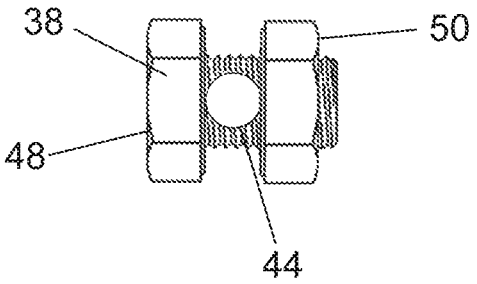
FIG. 13 is a side view of another exemplary embodiment of a releasable fastening means comprised of a fastening bolt with a receiving hole and a fastening nut.

In another embodiment of Applicant's resistance exercise device, the fastening means 38 is releasably fastened to the elongated element 24. The releasable fastening means 38 includes a two-piece screw retaining mechanism with a threaded screw piece secured in an outer piece by grooves complimentary to the screw threads. The releasable fastening means 38 also includes a receiving hole in one of the pieces for receiving and releasably fastening the elongated element between the two pieces when tightened together. Referring to FIG. 12, the releasable fastening means 38 includes a fastening body 42 with a receiving hole 44 for receiving the elongated element 24 and fastening screw 46 that screws into the fastener body 42 and through to the receiving hole 44 for tightening the elongated element 24 in place. Referring to FIG. 13, in still another embodiment, the releasable fastening means 38 comprises a fastening bolt 48 with a receiving hole 44 in the bolt shaft proximate the bolt head that receives the elongated element 24, and a fastening nut 50 that is screwed onto the fastening bolt 48 until the elongated element 24 is fastened in place between the two fastener pieces. Other embodiments of the fastening means 38 can be used as well. A benefit of a releasable fastening means 38 is that it allows changes to the configuration of the resistance exercise device 20, including adding or removing different fin modules 34, lights, small weights, noise makers, electronic devices and other components.

Figure 14:
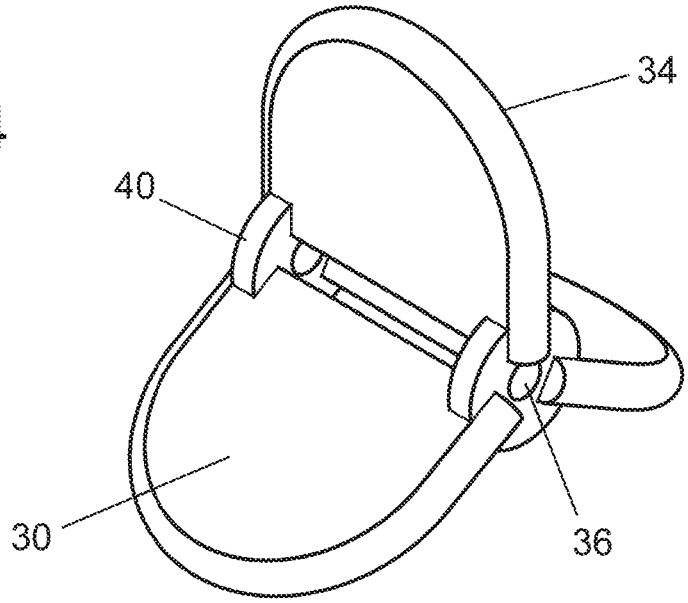
FIG. 14 is a perspective view of another exemplary embodiment of a fin module with three fins and an attachment means.
Figure 15:
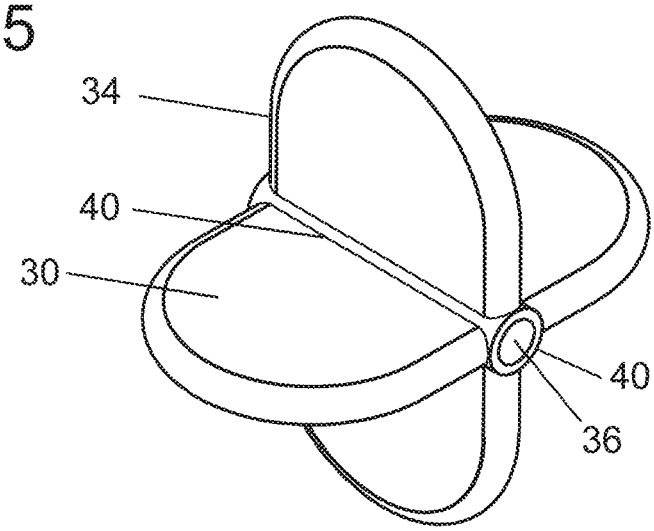
FIG. 15 is a perspective view of another exemplary embodiment of a fin module with four fins and a hub-shaped attachment means.

In one embodiment of Applicant's resistance exercise device, another fastening means 38 is fastened to the elongated element 24, disposed between the elongated handle 22 and the fin modules 34. This fastening means 38, which can be a collared crimp fastener, holds the fin modules 34 within a predetermined portion of the elongated element 24 and/or keeps the fin modules 34 a predetermined distance from the elongated handle 22. In another embodiment of the invention, the resistance fins 30 of a fin module 34 are attached together and rotatably attached to the elongated element 24 including an attachment means 40, as shown in FIG. 14. In yet another embodiment, the attachment means 40 can be hub shaped or can include a hub shaped portion, as shown in FIG. 15.

The rotary resistance exercise device 20 provides resistance exercise for the arms and upper body that can be used for strength building, muscle toning, rehabilitation exercise, and aerobic conditioning, and when combined with lower body exercise provides a full body workout. The exercise device 20 helps improve endurance, agility and flexibility. The exercise device 20 provides both weight resistance and air resistance, with an emphasis on air resistance. The exercise device 20 can provide substantial rotary resistance exercise even at moderate whirling speeds. The shorter embodiment of the exercise device 20 can be used as a single unit, especially when doing high intensity whirling. Or it can be used in pairs, providing resistance identical to that of a jump rope, including the same ratio of weight and air resistance. The exercise device 20 can be combined with lower body exercise for a variety of exercises and uses. The longer embodiment of the exercise device 20 is typically used as a single unit, and it can be held with one or two hands. Here the exercise device 20 can be used for whirling horizontally overhead, whirling vertically and at all angles in between, as well as for other exercises.

The exercise device 20 is safe to use. The elongated element 24 and attached resistance fins 30, as well as the fin modules 34, can spin freely. The exercise device 20 is lightweight and can be made of soft materials with rounded resistance fin corners and edges. Whirling a pair of the exercise devices 20 forms a slightly V-shaped pattern, which keeps the exercise device 20 a safe distance from a user's head. The light weight design encourages long workouts without causing premature arm fatigue.

The resistance exercise device 20, when used in pairs, provides an excellent aerobic workout for users of all fitness levels. Without the restriction of jumping over a rope, the exercise device 20 provides a wide variety of exercise possibilities. Different arm and upper body exercises can be performed. The exercise device 20 can be used with arms out to the side, out to the front, at shoulder height or overhead. Arms can be moved together or each arm can perform a different movement. For example, one arm can be whirling at the user's side while one arm is whirling overhead. A range of whirling motions are possible, from just rotating wrists to whirling forearms to moving entire arms in large circular movements. The exercise device 20 can be combined with just about any lower body exercise, including jumping of all varieties, walking/running in place, squats, lunges, leg lifts, kicks of many varieties, faux jumps where feet don't leave the floor, as well as with other lower body exercise. Also, a user can use it while standing or sitting. The exercise device 20 is easy to learn and easy to use. High speed rope jumping, while difficult to learn using a jump rope, is quickly mastered with the exercise device 20. The same is true for jumping rope backwards.

The exercise device 20 is portable and can be used in a variety of locations, including at home, at the fitness center, in classes or outside while walking or running. The exercise device 20 offers a unique total body workout, including strength building, high intensity training and aerobic conditioning. The exercise device 20 offers a plethora of exercise movements and is fun to use. The exercise device 20 provides a wide range of intensity levels and is effective for achieving a high level of physical fitness. The exercise device 20 provides unique rotary resistance exercise and complements fitness workouts, increasing strength, fitness and endurance in a way no other exercise device can do.

It is understood that the preceding relates to exemplary embodiments of the invention and that changes can be made without departing from the spirit and scope of the invention as set forth in the following claims.

What is claimed is:

1. A resistance exercise device that is held in at least one hand of a user and whirled in use, comprising:

an elongated handle having a first handle end and a second handle end;

an elongated element having a first end, a second end, and defining a longitudinal axis extending through the first end and the second end, at least a portion of the elongated element proximate the first end being flexible;

a coupling connecting the elongated element at or near the first end to the elongated handle at or near the first handle end; and a plurality of resistance fins attached to the elongated element, the resistance fins disposed around and along a portion of the elongated element and oriented in an outwardly direction from the longitudinal axis, the elongated element and attached resistance fins being at least generally symmetrical along the longitudinal axis, whereby when whirled in use, the elongated element and the attached resistance fins prevent rotation about the longitudinal axis and produce a substantially continuous resistance exercise.

2. The resistance exercise device as in claim 1, wherein at least three resistance fins are attached to the elongated element.

3. The resistance exercise device as in claim 1, wherein the resistance fins are attached proximate a fin edge to the elongated element.

4. The resistance exercise device as in claim 1, further including a rotatable coupling that rotatably couples the elongated element to the elongated handle.

5. The resistance exercise device as in claim 1, wherein at least three resistance fins are attached proximate a fin edge to the elongated element, and further including a rotatable coupling that rotatably couples the elongated element to the elongated handle.

6. The resistance exercise device as in claim 1, wherein the resistance fins are arranged in groups along the elongated element.

7. The resistance exercise device as in claim 1, further including an attachment means that attaches one or more resistance fins to the elongated element.

8. The resistance exercise device as in claim 1, wherein each resistance fin has a radial length of no greater than 7 inches.

9. A resistance exercise device that is held in at least one hand of a user and whirled in use, comprising:

an elongated handle having a first handle end and a second handle end;

an elongated element having a first end, a second end, and defining a longitudinal axis extending through the first end and the second end, at least a portion of the elongated element proximate the first end being flexible;

a coupling connecting the elongated element at or near the first end to the elongated handle at or near the first handle end; and a fin module comprised of at least three resistance fins attached together, the fin module having two ends and defining a central axis extending through the two ends, the resistance fins disposed around the central axis and oriented in an outwardly direction from the central axis; the fin module at least generally symmetrical along the central axis, and at least one fin module rotatably attached to the elongated element; whereby when the exercise device is whirled in use, the elongated element and attached resistance fins are at least generally symmetrical about the longitudinal axis.

10. The resistance exercise device as in claim 9, further including an axial through hole along the central axis of the fin module and a fastening means fastened to the elongated element proximate the second end.

11. The resistance exercise device as in claim 9, wherein the resistance fins are attached proximate a fin edge to each other.

12. The resistance exercise device as in claim 9, wherein a plurality of fin modules are rotatably attached to the elongated element.

13. The resistance exercise device as in claim 9, further including a rotatable coupling that rotatably couples the elongated element to the elongated handle.

14. The resistance exercise device as in claim 9, further including an attachment means that attaches the resistance fins together and rotatably attaches the fin module to the elongated element, at least one fin module including an attachment means.

15. The resistance exercise device as in claim 14, wherein a plurality of fin modules are rotatably attached to the elongated element, and further including an axial through hole along the central axis of the fin module and a fastening means fastened to the elongated element proximate the second end.

16. The resistance exercise device as in claim 15, wherein the resistance fins are attached proximate a fin edge to each other, and further including an attachment means that attaches the resistance fins together and rotatably attaches the fin module to the elongated element, at least one fin module including an attachment means.

17. The resistance exercise device as in claim 9, wherein each resistance fin has a radial length of no greater than 7 inches.

18. A method of exercising, comprising the steps of:

providing a resistance exercise device comprising:

an elongated handle having a first handle end and a second handle end;

an elongated element having a first end, a second end, and defining a longitudinal axis extending through the first end and the second end, at least a portion of the elongated element proximate the first end being flexible;

a coupling connecting the elongated element at or near the first end to the elongated handle at or near the first handle end; and a plurality of resistance fins attached to the elongated element, the resistance fins disposed around and along a portion of the elongated element and oriented in an outwardly direction from the longitudinal axis, the elongated element and attached resistance fins being at least generally symmetrical along the longitudinal axis, whereby when whirled in use, the elongated element and the attached resistance fins prevent rotation about the longitudinal axis and produce a substantially continuous resistance exercise;

holding in at least one hand of a user the elongated handle; and whirling the elongated element and attached fins about the elongated handle.

19. A method of exercising as in claim 18, wherein at least three resistance fins are attached proximate a fin edge to the elongated element, and further including a rotatable coupling that rotatably couples the elongated element to the elongated handle.

20. A method of exercising as in claim 18, wherein a fin module is comprised of at least three resistance fins attached together, the fin module having two ends and defining a central axis extending through the two ends, the resistance fins disposed around the central axis and oriented in an outwardly direction from the central axis; the fin module at least generally symmetrical along the central axis, and at least one fin module rotatably attached to the elongated element; whereby when the resistance exercise device is whirled in use, the elongated element and attached resistance fins are at least generally symmetrical about the longitudinal axis.

21. A method of exercising as in claim 20, the resistance exercise device further comprising a rotatable coupling that rotatably couples the elongated element to the elongated handle, an axial through hole along the central axis of the fin module, a fastening means fastened to the elongated element proximate the second end, and wherein a plurality of fin modules are rotatably attached to the elongated element.

22. A method of exercising as in claim 21, wherein the resistance fins are attached proximate a fin edge to each other.

23. A method of exercising as in claim 18, wherein the elongated element and attached fins are whirled about the elongated handle overhead, to a side of the user, in front of the user or somewhere between these different locations around the user.

24. A method of exercising as in claim 18, wherein each resistance fin has a radial length of no greater than 7 inches.

* * * * *